US008716923B2

(12) United States Patent
Mahon

(10) Patent No.: US 8,716,923 B2
(45) Date of Patent: May 6, 2014

(54) SPARK PLUG ASSEMBLY

(76) Inventor: Shannon S. K. Mahon, Timmonsville, SC (US)

( * ) Notice: Subject to any disclaimer, the term of this patent is extended or adjusted under 35 U.S.C. 154(b) by 13 days.

(21) Appl. No.: 13/253,779

(22) Filed: Oct. 5, 2011

(65) Prior Publication Data

US 2012/0176018 A1 Jul. 12, 2012

Related U.S. Application Data

(60) Provisional application No. 61/390,521, filed on Oct. 6, 2010.

(51) Int. Cl.
*H01T 13/08* (2006.01)
*H01T 13/12* (2006.01)

(52) U.S. Cl.
USPC ..... 313/122; 313/121; 313/125

(58) Field of Classification Search
USPC ..... 313/118–145
See application file for complete search history.

(56) References Cited

U.S. PATENT DOCUMENTS

| | | | | |
|---|---|---|---|---|
| 1,523,522 | A * | 1/1925 | Graf | 313/146 |
| 5,186,132 | A * | 2/1993 | Runge | 123/169 R |
| 5,839,403 | A | 11/1998 | Grant et al. | |
| 6,363,898 | B1 * | 4/2002 | Ripma et al. | 123/169 R |

* cited by examiner

*Primary Examiner* — Karabi Guharay
*Assistant Examiner* — Nathaniel Lee
(74) *Attorney, Agent, or Firm* — Nelson Mullins Riley & Scarborough, LLP

(57) ABSTRACT

A spark plug assembly has a spark plug with an inner conductor, an outer conductor and an intervening insulator. A quick-change adapter is receivable in the spark plug hole of an internal combustion engine, and the spark plug is removably received in the adapter. Gas seal rings may be provided about the spark plug outer surface. Indexing marks may be provided on the adapter and the spark plug to angularly align the spark plug conductor gap to a desired angular position. The spark plug may be formed with an extension.

7 Claims, 8 Drawing Sheets

SPARK PLUG ASSEMBLY

CLAIM OF PRIORITY

The present application claims priority to U.S. Provisional Patent Application Ser. No. 61/390,521, filed Oct. 6, 2010, the entire disclosure of which is incorporated by reference herein.

BACKGROUND OF THE INVENTION

The use of spark plugs in internal combustion engines is well known. Generally, spark plugs have an inner conductor, an outer conductor, and an insulator between the two conductors. The spark plug threads into a threaded hole in the head of the internal combustion engine so that terminating ends of the first and second conductors extend into an enclosed area of the engine that contains fuel vapor so that a spark generated across a gap between the terminating ends ignites the vapor.

In use of spark plugs in racing engines, it is known to index a plug so that the gap between the terminating ends of the conductors opens at a desired angular position with respect to the spark plug's axis. Indexing plugs to desired positions is generally believed to increase engine horsepower. In general, indexing is achieved by placing washers above the spark plug thread so that the threaded connection between the spark plug and the engine head stops at a point corresponding to a desired angular position for the plug.

It is also known to remove a spark plug's outer thread so that the spark plug may be inserted into a quick-change sleeve that threads into the spark plug hole, for example as described in U.S. Pat. No. 5,839,403.

SUMMARY OF INVENTION

In one embodiment of the present invention, a spark plug assembly has a spark plug having an inner conductor, an outer conductor, and an insulator disposed between the inner conductor and the outer conductor. At a lower end of the plug, the inner conductor and outer conductor respectively terminate to define a gap therebetween and across which a spark is created in use. A first indexing mark is provided on an upper portion of the plug. An adaptor has a sleeve that defines an inner bore that receives the plug through an upper end of the sleeve and a thread on an outer surface of a lower end of the sleeve opposite the upper end. A retainer is connected between the sleeve and the plug so that, when the plug is inserted into the bore so that the inner and outer conductors extend out of the lower end of the sleeve and the gap is outside the sleeve, the retainer retains the plug in the bore against movement out of the bore through the upper end in a direction along an axis of the bore, and the retainer allows rotation of the plug about the axis when the plug is inserted into the bore and retained by the retainer. The adaptor has a plurality of second indexing marks disposed on the adaptor so that, upon insertion of the plug into the adaptor, alignment of the first indexing mark with any one of the second indexing marks brings an opening of the gap to a predetermined rotational position with respect to the axis.

In another embodiment of the present invention, the spark plug assembly has a spark plug with a first inner conductor exposed at an upper end of the plug, a first outer conductor, an insulator disposed between the inner conductor and the outer conductor, and a threaded outer surface of a lower end of the plug opposite the upper end of the plug. An elongated extension member has a first bore at an upper end of the extension member. The first bore defines a threaded inner surface that threadedly receives the threaded outer surface of the lower end of the plug to thereby secure the plug to the extension member. A second inner conductor is disposed within the first bore so that the first inner conductor electrically engages the second inner conductor when the spark plug is threadedly secured to the extension member. A second outer conductor is disposed so that the first outer conductor electrically engages the second outer conductor when the plug is threadedly secured to the extension member. At a lower end of the extension member, the second inner conductor and the second outer conductor respectively terminate to define a gap therebetween and across which a spark is created in use. An adaptor has a sleeve that defines a second bore that receives the extension member through an upper end of the sleeve and a thread on an outer surface of a lower end of the sleeve opposite the upper end. A retainer is connected between the sleeve and the plug so that, when the extension member is inserted into the second bore so that the inner and outer conductors extend out of the lower end of the sleeve and the gap is outside the sleeve, the retainer retains the extension member in the bore against movement of the second bore through the upper end in a direction along an axis of the second bore.

In a still further embodiment of the present invention, a spark plug assembly has a spark plug with an inner conductor, an outer conductor, an insulator disposed between the inner conductor and the outer conductor, and an annular seal ring disposed on the outer conductor and extending around an outer surface of the plug. At a lower end of the plug, the inner conductor and outer conductor respectively terminate to define a gap therebetween and across which a spark is created in use. An adaptor has a sleeve that defines an inner bore that receives the plug through an upper end of the sleeve, so that the seal ring engages an inner surface of the inner bore, and a thread on an outer surface of a lower end of the sleeve opposite the upper end. A retainer is connected between the sleeve and the plug so that, when the plug is inserted into the bore so that the inner and outer conductors extend out of the lower end of the sleeve and the gap is outside the sleeve, the retainer retains the plug in the bore against movement of the bore through the upper end in a direction along the axis of the bore.

BRIEF DESCRIPTION OF THE DRAWINGS

The accompanying drawings, which are incorporated in and constitute a part of this specification, illustrate one or more embodiments of the invention and, together with the description, serve to explain the principles of the invention. A full and enabling disclosure of the present invention, including the best mode thereof, directed to one of ordinary skill in the art, is set forth in the specification, which makes reference to the appended drawings, in which.

Figure 1A:
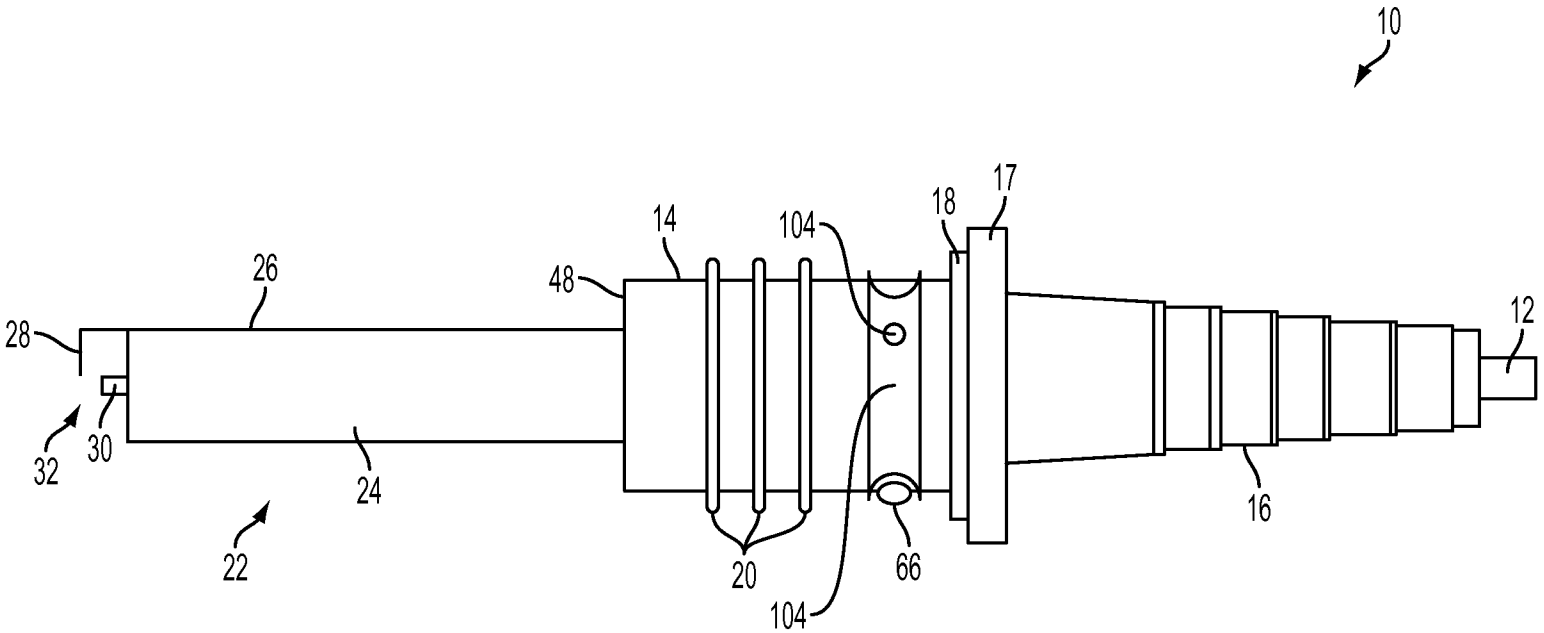
FIG. 1A is a side view of a spark plug for use in an assembly in accordance with an embodiment of the present invention.

Repeat use of reference characters in the present specification and drawings is intended to represent same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the present disclosure, including appended claims and their equivalents.

Referring now to FIG. 1A, a spark plug 10 has a first conductor 12, a second conductor 14 and an insulator 16 between the first and second conductors. Second conductor 14 is configured as a conductive sheath made of stainless steel, hardened steel or other conductive material. The particular construction of inner electrode 12, and the configuration of the inner electrode and the intervening insulator, are not in and of themselves part of the present invention. Such construction should be well understood and is, therefore, not discussed in further detail herein.

Outer conductor 14 terminates at its upper end at a radially outwardly extending shoulder 17. In the absence of the adapter described below and if lower end 26 were threaded to thread the plug into the engine head, a shoulder 48 would seat against a metal surface of the engine head, thereby connecting outer conductor 14 to ground. In this embodiment, however, shoulder 48 seats against an opposing surface of the adapter to provide a ground connection, which is also provided by connection between rings 20 and the adapter's inner diameter and possibly by seating of shoulder 17 against a top surface of the adapter, as described in more detail below. An O-ring gasket 18 sits below shoulder 17 and provides a high temperature seal at the opening in the adapter. A plurality (in this embodiment, three) cast iron, ductile steel, chrome-molybdenum-coated cast iron, or other suitable material gas-ring seals 20 secured in grooves about outer conductor sleeve 14 provide an additional seal between the spark plug and the adapter's inner surface to prevent escape of high-pressure gases released from fuel vapor ignition. The ID of rings 20 may be formed slightly smaller than the OD of the upper section of the plug encased by outer conductor 14 (i.e. above shoulder 48) so that, when rings 20 are pushed over that part of the plug, they snap into the grooves.

At a lower end 22 of plug 10, conductor sleeve 14 ends at a point 24 except for an extension 26 that terminates in a L-shaped tang 28. The end of tang 28 opposes a terminating end 30 of conductor 12 to define a gap 32 therebetween. Due to the shape of tang 28, gap 32 opens in a downward direction in the perspective of FIG. 1A.

Figure 1B:
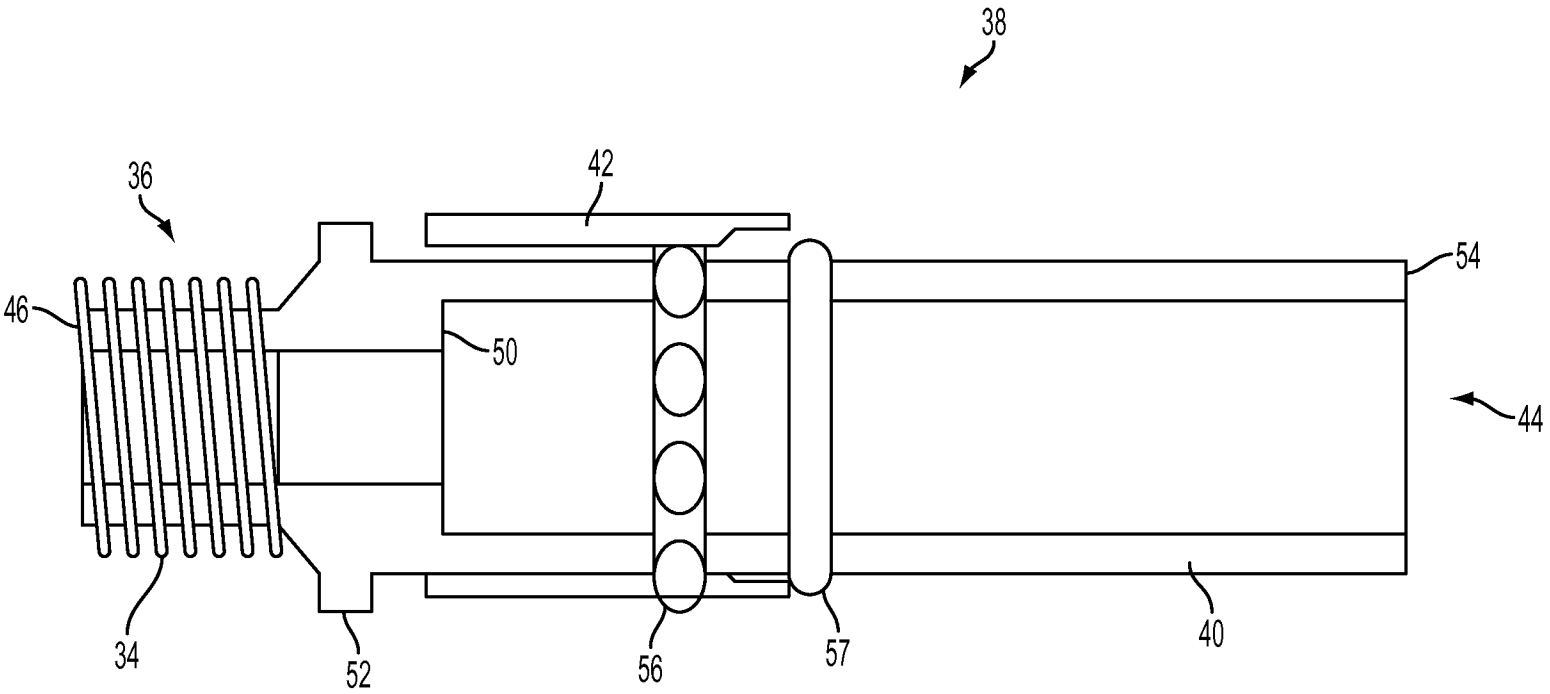
FIG. 1B is a schematic side view, partly in section, of an adaptor for use with the spark plug as in FIG. 1A.
Figure 1C:
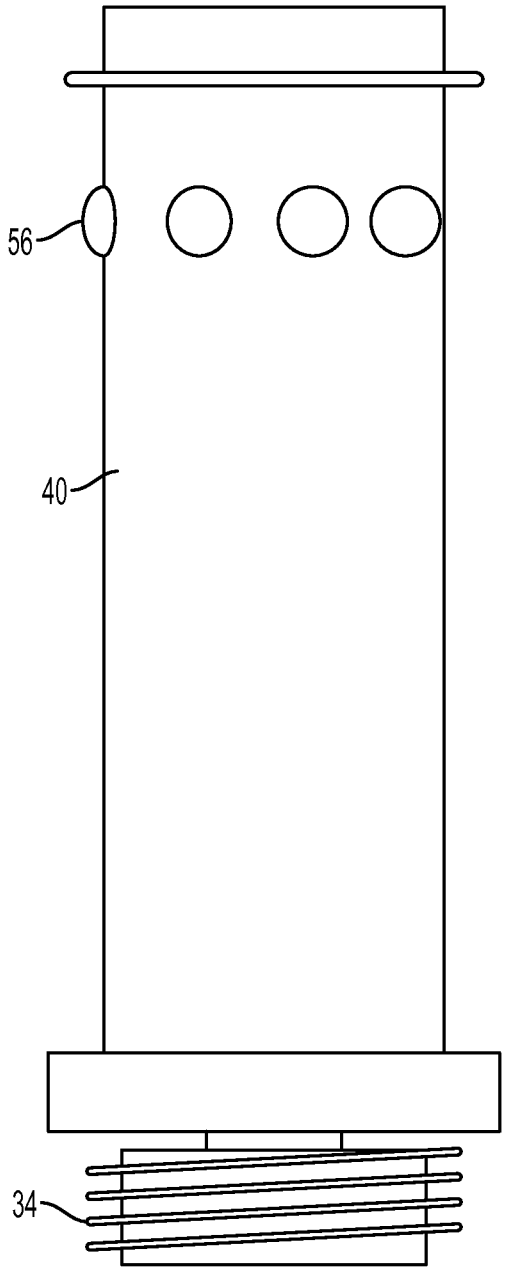
FIG. 1C is a side view of a casing portion of the adaptor shown in FIG. 1B.
Figure 1D:
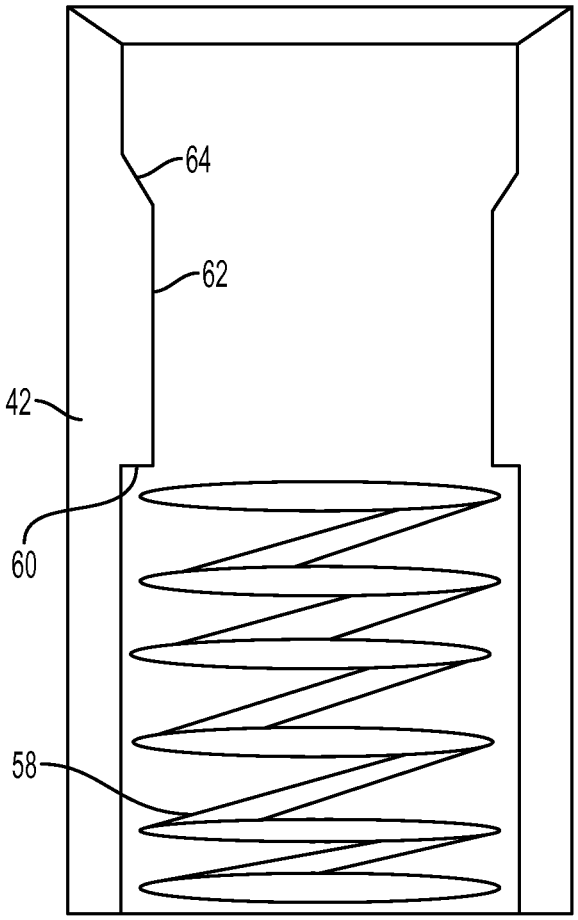
FIG. 1D is a side view, partly in section, of a detent sleeve and spring of the adaptor shown in FIG. 1B.

As is apparent from FIG. 1A, threads that would be normally provided at lower end 22 of the spark plug below point 24 are omitted. Referring also to FIGS. 1B, 1C and 1D, threads 34 are instead provided at a lower end 36 of an adapter 38 comprised of a main cylindrical sleeve 40 and a locking or detent sleeve 42. The adapter's lower end is configured correspondingly to a standard spark plug so that adapter 38 may be threadedly installed into a spark plug hole in place of a spark plug. In turn, main sleeve 40 defines a generally cylindrical bore 44 into which is inserted spark plug 10 bottom-end first so that terminating ends 28 and 30 of the outer and inner conductors extend beyond a bottom face 46 of sleeve 40 and so that gap 32 is outside bore 44 and beyond the adapter bottom face 46. A ledge 48 of spark plug 10 seats against an opposing ledge 50 of sleeve 40 so that outer conductor 14 electrically engages sleeve 40, which is made of steel or other electrically conductive material. Sleeve 40 may define a radially-outwardly extending annular flange 52 that, as described below, provides a seat for a spring between sleeve 40 and sleeve 42. Not shown is a washer that seats against the outer surface of sleeve 40 above threads 34 that, when sleeve 40 is threaded into a spark plug hole, provides a seal against the outer metal surface of the engine head. Annular collar 17 of spark plug outer conductor 14 seats against a top flange 54 of sleeve 40. A lock collar or circlip 57 is secured about the outer surface of sleeve 40 as a stop to restrict upward movement of sleeve 42 to retain sleeve 42 on sleeve 40. In FIGS. 1A and 1B, the distance between a detent groove 66 and shoulder 17 in FIG. 1A is smaller than the distance between balls 56 and flange 54 in FIG. 1B. In practice, however, these distances will correspond to each other, and it should be understood that the respective distances on the two parts can vary together as desired.

A plurality of balls 56 seat in through-holes in sleeve 40 having dimensions such that the balls may extend partially into, but may not pass through into, bore 44. Locking sleeve 42 is shown in its normal position surrounding sleeve 40 and biased toward the upper end of sleeve 40 and bore 44 by a spring 58 that sits between annular flange 52 and radially-inward annular shoulder 60. In this normal position, a radially-inwardly extending annular surface 62 on the inner diameter of sleeve 42 pushes balls 56 radially-inward. Upon manual retraction of sleeve 42 against the biasing force of spring 58 in the lower direction away from the upper end of sleeve 40, the inner diameter of sleeve 42 moves to a position at which a frustoconical surface 64 opposes balls 56, thereby allowing balls 56 to move radially outward. In this condition of the sleeve, it is possible to insert spark plug 10 through bore 44 to its operative position as described above, since balls 56 are movable radially outward to allow the spark plug's passage into the bore. When the spark plug is fully inserted into the adapter bore, so that ledge 48 abuts ledge 50, detent groove 66 defined in the plug's outer conductor 14 opposes balls 56. Upon release of outer sleeve 42, spring 58 returns sleeve 42 to its position shown in FIG. 1B, pushing balls 56 into groove 66 and thereby locking spark plug 10 into position in the adapter.

Figure 2:
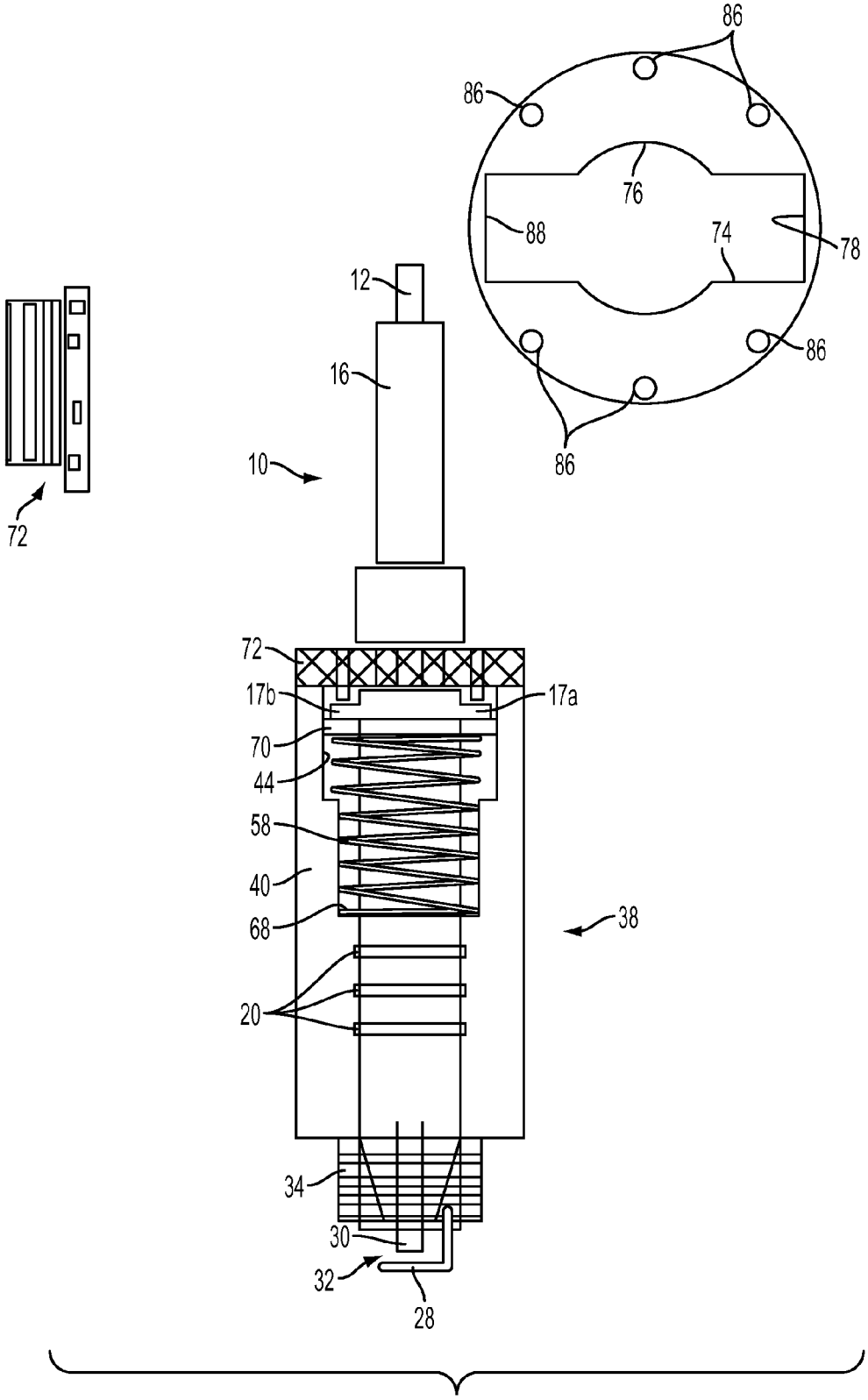
FIG. 2 is a schematic illustration of a spark plug assembly according to an embodiment of the present invention.

In an embodiment illustrated in FIG. 2, spark plug 10 has the same construction as shown and described above with regard to FIG. 1A, except that groove 66 is omitted, and the spark plug's lower half has a straight cylindrical shape rather than the stepped shape shown in FIG. 1A. Adaptor 38 again includes a sleeve 40, but in this embodiment, locking sleeve 42 is omitted, and spring 58 is disposed internally of sleeve 40 within bore 44 (see FIG. 1B) between a ledge 68 and an annular washer 70 movably disposed within the bore.

When spark plug 10 is not inserted into adaptor 38, spring 58 biases washer 70 upward against a bottom surface of an end cap 72 threadedly secured to sleeve 40, so that washer 70 rests against a lower surface of an inwardly projecting top portion of cap 72. The top portion of cap 72 defines an elongated through-slot 74 having a generally circular center portion 76 and two side portions 78 and 80. Generally circular portion 76 is sufficiently large to allow passage of the generally cylindrical lower portion of spark plug 10. In this embodiment, the spark plug's annular shoulder 17 (FIG. 1A) is replaced by two opposing flanges 17*a* and 17*b* extending from opposites sides of the spark plug body. When the spark plug is inserted through the elongated slot 74, the opposing flanges 17*a* and 17*b* pass through slot ends 78 and 80, respectfully, so that the flanges engage washer 70 and push it downward into bore 44 against the force of spring 58 as a user inserts the plug into the adapter. When the flanges clear cap 72 upon passing through slot ends 78 and 80, the user rotates the spark plug at least slightly about its longitudinal axis so that flanges 17*a* and 17*b* are no longer aligned with slot ends 78 and 80. Thus, flanges 17*a* and 17*b* are wedged by the force of spring 58 between a top surface of washer 70 and a bottom surface of the top portion of cap 72, thereby locking spark plug 10 in position within adapter 38. Alternatively, the spring 58 could be retained in the upper direction by a circlip inside sleeve 40 that is in turn retained by an inwardly depending shoulder of sleeve 40, and the cap could be threaded onto the housing after installation of the plug.

A reference line 84 is provided on the outer surface of insulator 16 of spark plug 10, generally parallel to the spark plug's axis. Because spark plug 10 is rotatable within adapter 38, the user may manually rotate spark plug 10 until reference line 84 is in angular alignment (with respect to the spark plug and adapter axis) with one of a plurality of index points 86 made on a top surface of cap 72. Index points 86 may be established in any suitable manner, for example through indicia provided on the cap top or dimples provided in the top, or pins extending through the cap top, or marks or other indicia or structure provided on the adapter side. Reference line 84 may be disposed on the spark plug upper portion so that alignment with any one of the reference points 86 disposes gap 32 so that the opening in gap 32 points in a predetermined angular direction with respect to the plug axis. For example, consider that the opening of gap 32 in FIG. 2 points to the left (in the perspective of FIG. 2). Reference line 84 may be placed on the plug with respect to the gap opening so that the gap opening points in a direction extending from reference line 84 toward the indexing point 86 with which it is aligned, in a direction perpendicular to the spark plug axis.

Figure 3:
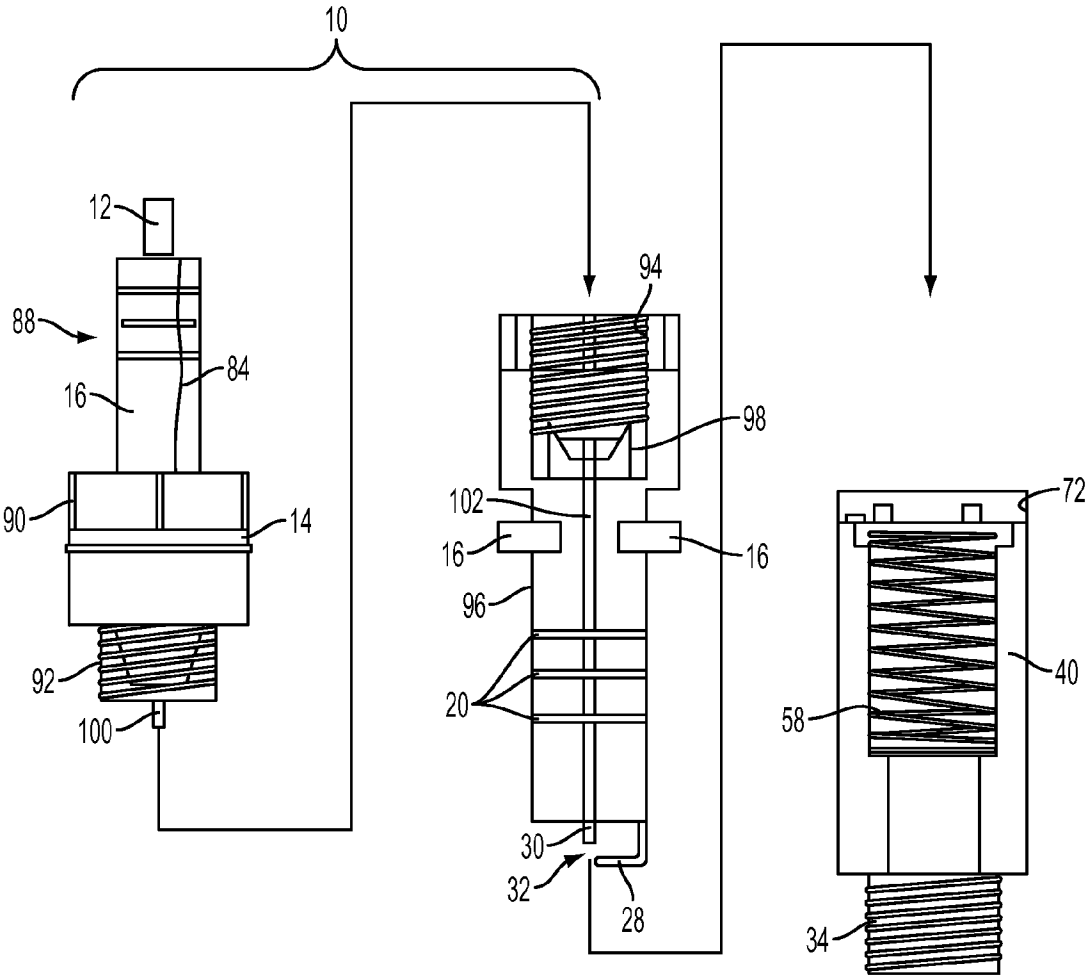
FIG. 3 is a schematic illustration of a spark plug assembly in accordance with an embodiment of the present invention.

Referring now to FIG. 3, a further embodiment of a spark plug assembly is similar to the assembly shown in FIG. 2, except that spark plug 10 is formed in two sections. A first portion 88 is a conventional off-the-shelf spark plug, except that the outer conductor's lower extension 26 and terminating portion 28 (FIG. 1A) are removed. Spark plug 88 has an inner conductor 12, an outer conductor 14, and an intervening insulator 16. An upper portion of outer conductor 14 may be configured in a hexagonal shape at 90 to facilitate the spark plug's installation by a wrench. A bottom portion 92 of the insulating portion 16 is threaded so that spark plug 88 may be threadedly received by a threaded internal bore 94 of a spark plug extension 96. When threadedly inserted into extension 96, the lower end of 92 of spark plug 88 engages a bottom portion 98 of bore 94 so that a bottom end 100 of inner conductor 12 electrically engages an inner conductor 102 that extends from bore 94 to terminating end 30. An outer portion of the body of extension 96, and including a portion of extension 96 that defines bore 94, is made of steel or other conductive metal so that outer conductor 14 electrically connects with the outer portion of extension 96. An insulator (not shown in FIG. 3) electrically isolates the inner conductor of extension 96 from the outer conductor, except of course that a spark may be generated across gap 32.

The assembly shown in FIG. 3 operates as described above with regard to the embodiment of FIG. 2, including with respect to the alignment of an indexing line 84 on the spark plug with indexing points provided on cap 72. Extension 96 of FIG. 3, however, increases the overall length of spark plug 10 from that shown in FIG. 2, for example, by a factor of 1.5 to 2.0. As should be understood in this art, spark plug 10 is connected to a vehicle electrical system by a bonnet (not shown) that fits over the upper end of the spark plug to electrically connect the upper end of inner conductor 12 with a wire (not shown) extending from the bonnet. The extension of length provided by extension 96 puts the bonnet and wire further away from the engine head than does the embodiment of FIG. 2, thereby protecting the bonnet and wire from heat and potentially extended the operative lives of these components. Extension 96 also puts hexagonal portion 90 further away from the engine head, thereby facilitating access to the hexagonal portion for ease of the spark plug's installation and removal.

It should be understood that the indexing mechanism illustrated in FIGS. 2 and 3 may also be practiced with regard to the embodiment shown in FIG. 1. Thus, for instance, a longitudinal indexing line 84 (FIG. 2) may be disposed along insulator 16 shown in FIG. 1A, in a plane including the spark plug axis. Indexing marks may be provided on the outer surface of sleeve 40 or, where sleeve 42 is rotationally fixed with respect to sleeve 40, on an outer surface of locking sleeve 42. In such embodiment, groove 66 in the outer conductor 14 of spark plug 10 may be formed without dimples or other individual recesses for balls 56. That is, groove 66 has a smooth and continuous bottom surface in this embodiment so that spark plug 10 is freely rotatable within adapter 38 to thereby align the indexing mark on the spark plug with a desired indexing mark on the adapter.

Figure 4:
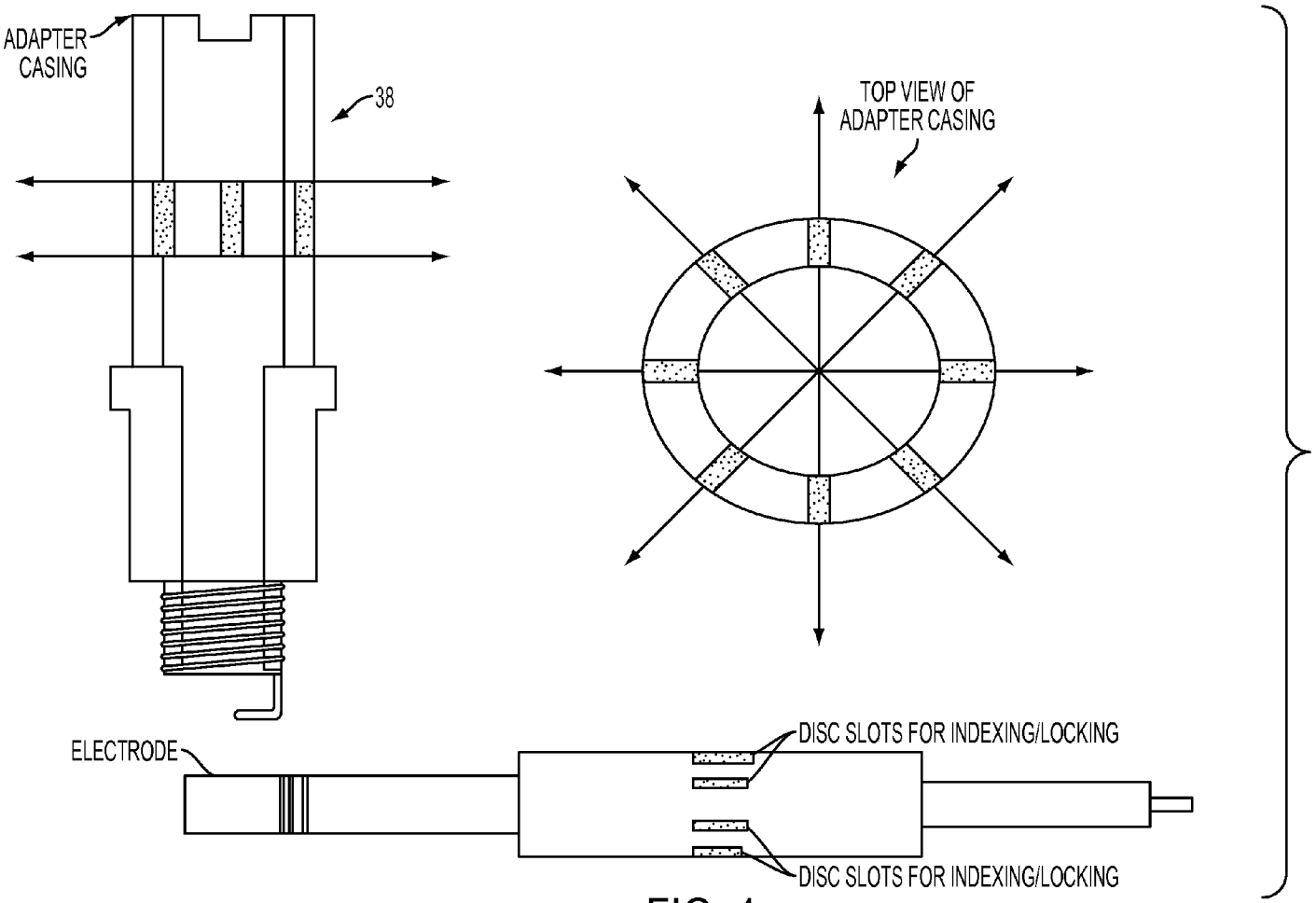
FIG. 4 is a schematic illustration of a spark plug assembly in accordance with an embodiment of the present invention.

Referring to FIGS. 1A and 4, however, groove 66 in outer conductor 14 may alternatively be formed with individual dimples 104 in the bottom of groove 66 so that balls 56 (FIG. 1B and FIG. 1C) are received individual respective pockets 104. The indexing line on the spark plug is positioned with respect to pockets 104 so that when balls 56 are received in the pockets, spark plug 110 is rotationally locked in a predetermined angular position so that the spark plug indexing line is angularly aligned with one of the plurality of indexing marks on the adapter. Thus, in operation, the user moves outer locking sleeve 42 down against the force of spring 58 so that the adapter is in an unlocked position, rotates spark plug 10 so that the spark plug's indexing mark is aligned with a desired one of the adapter's indexing marks, and then releases the locking sleeve so that the force of spring 58 biases balls 56 into locking engagement with dimples 104, thereby locking he spark plug into the desired indexing position. It should be understood that balls 56 may be replaced by other types of detent devices, such as flat discs aligned longitudinally with respect to the spark plug axis, as shown in FIG. 5.

Figure 5C:
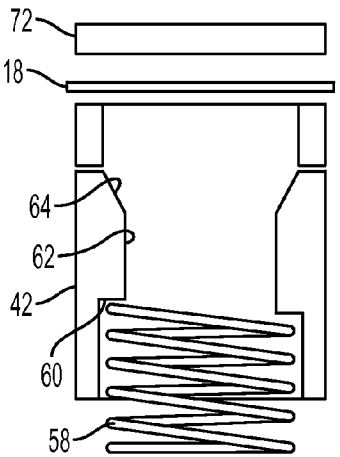
FIG. 5 is a schematic illustration of a spark plug assembly in accordance with an embodiment of the present invention.
Figure 5B:
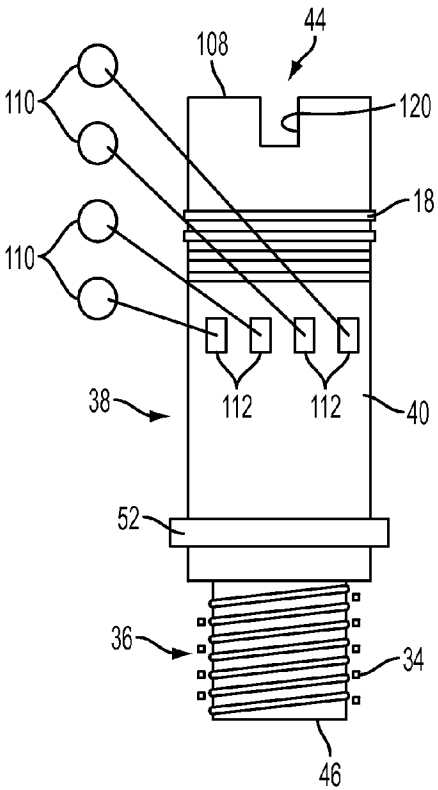
Figure 5A:
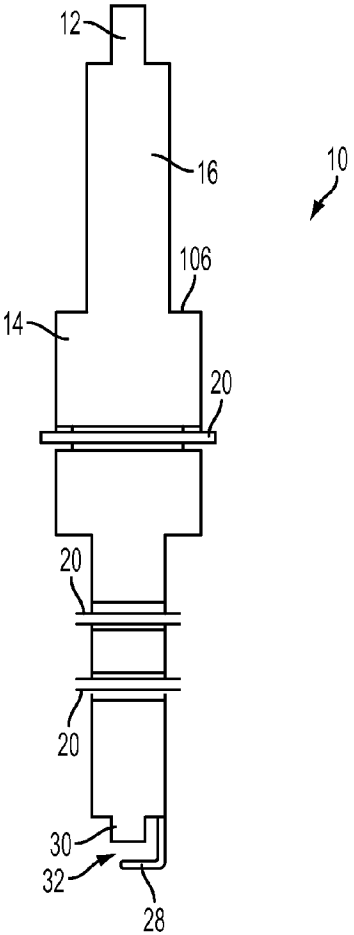

Referring to FIG. 5, a spark plug 10 has a first conductor 12, a second conductor 14 and an insulator 16 between the first and second conductors. Second conductor 14 is configured as a conductive sheath made of steel or other conductive material. Outer conductor 14 terminates at its upper end at a radially inwardly extending shoulder 106. A plurality (in this embodiment, three) O-ring seals 20 secured in annular grooves extending about outer conductor sleeve 14 provide a additional seal between the spark plug and the adapter's inner surface to prevent of high-pressure gases released from fuel vapor ignition.

At a lower end of plug 10, conductor sleeve 14 ends at a point short of the end of the insulator, except for an extension 26 that terminates in a L-shaped tang 28. The end of tang 28 opposes a terminating end 30 of conductor 12 to define a gap 32 therebetween. Due to the shape of tang 28, gap 32 opens in a leftward direction in the perspective of FIG. 5.

Threads that would be normally provided at lower end 22 of the spark plug are omitted. Threads 34 are instead provided at a lower end 36 of an adapter 38 comprised of a main cylindrical sleeve 40 and a locking or detent sleeve 42. The adapter's lower end is configured correspondingly to a standard spark plug so that adapter 38 may be threadedly installed into a spark plug hole in place of a spark plug. In turn, main sleeve 40 defines a generally cylindrical bore 44 into which is inserted spark plug 10 bottom-end first so that terminating ends 28 and 30 of the outer and inner conductors extend beyond a bottom face 46 of sleeve 40 and so that gap 32 is outside bore 44 and beyond the adapter bottom face 46.

When plug 10 is inserted into adapter 38, upwardly facing shoulder 106 is flush with a radially inward shoulder 108 of adapter 38. A threaded locking collar 72 has a center hole (not shown) through which the top part of plug 10 passes as collar 72 is placed over the plug and threaded onto external threads (not shown) provided on adapter 38, thereby retaining the plug against movement in the upward direction. A steel locking ring 18 is received by snap fit in a groove in adapter sleeve 40 below cap 72 to establish a stop in the upward direction for movement of sleeve 42, similarly to ring 57 discussed above with respect to FIG. 1. Alternatively, and particularly where the device is used with non-high performance, lower compression engines, collar 72 may be omitted, and plug 10 is retained in adapter 38 solely by disks 110. Ground connection is provided by engagement of the disks in a disk-receiving groove in the plug's outer conductor 14. Sleeve 40 defines a radially-outwardly extending annular flange 52 that, when sleeve 40 is threaded into a spark plug hole, seats against the outer metal surface of the engine head.

A plurality of flat disks 110 seat in respective through-holes in sleeve 40 having dimensions such that the disks may extend partially into, but may not pass through into, bore 44. Locking sleeve 42 is biased toward the upper end of sleeve 40 and bore 44 by a spring 58 that sits between annular flange 52 and radially-inward annular shoulder 60. In this normal position, a radially-inwardly extending annular surface 62 on the inner diameter of sleeve 42 pushes disks 110 radially-inward. Upon manual retraction of sleeve 42 against the biasing force of spring 58 in the lower direction away from the upper end of sleeve 40, the inner diameter of sleeve 42 moves to a position at which a frustoconical surface 64 opposes disks 110, thereby allowing disks 110 to move radially outward. In this condition of the sleeve, it is possible to insert spark plug 10 through bore 44 to its operative position as described above, since disks 94 are movable radially outward to allow the spark plug's passage into the bore. When the spark plug is fully inserted into the adapter bore, so that shoulder 106 is flush with shoulder 108, a detent groove (not shown) defined in the plug's outer conductor 14 opposes disks 110. Upon release of outer sleeve 42, spring 58 returns sleeve 42 to its upward, pushing disks 110 into the groove and thereby locking spark plug 10 into position in the adapter. As described above, an index mark may be provided on the upper part of the spark plug, and index marks may be provided on sleeve 40 and/or sleeve 42 to allow for positioning the plug to selectively angularly position gap 32 with respect to the plug's axis. Also as described above, dimples or other depressions or holes may be provided in the disk-receiving groove correspondingly to predetermined angular positions of gap 32 and, therefore, to predetermined alignments between the plug's indexing mark and respective indexing marks on the adapter to thereby define predetermined angular resting positions for the spark plug when disks 110 are received in respective dimples/depressions. A slot 120 extending across the top of adapter 38 is provided to receive a tool by which adapter 38 may be turned to thread adapter 38 into a threaded spark plug hole.

These and other modifications and variations to the present indention may be practiced by those of ordinary skill in the art, without departing from the spirit and scope of the present invention. In addition, it should be understood that aspects of the various embodiments may be interchanged both in whole and in part. Furthermore, those of ordinary skill in the art will appreciate that the foregoing description is by way of example only and is not intended to limit the invention so further described in such appended claims.

What is claimed is:

1. A spark plug assembly, comprising:

a spark plug comprising an inner conductor, an outer conductor, wherein at a lower end of the plug, the inner conductor and outer conductor respectively terminate to define a gap there between across which a spark is created in use of the plug, an insulator disposed between the inner conductor and outer conductor, and a first indexing mark on an upper portion of the plug; and an adapter comprising a sleeve that defines an inner bore that receives the plug through an upper end of the sleeve and a thread on an outer surface of a lower end of the sleeve opposite the upper end, a retainer connected between the sleeve and the plug so that, when the plug is inserted into the bore so that the inner and outer conductors extend out of the lower end of the sleeve and the gap is outside the sleeve, the retainer retains the plug in the bore against movement out of the bore through the upper end in a direction along an axis of the bore and the retainer allows rotation of the plug about the axis when the plug is inserted into the bore and retained by the retainer, and a plurality of second indexing marks disposed on the adapter so that, upon insertion of the plug into the adapter, alignment of the first indexing mark with any one of the second indexing marks brings an opening of the gap to a predetermined rotational position with respect to the axis.

2. The assembly as in claim 1, wherein the retainer comprises a shoulder that extends radially inwardly from a periphery of the sleeve toward the axis, wherein the shoulder defines a generally elongated slot, wherein the plug has a generally cylindrical body and opposing flanges extending radially outward from the body, and wherein the slot is large enough to allow passage of the flanges so that, upon insertion of the plug into the bore through the slot so that the flanges pass through the slot into the bore, rotation of the plug so that the flanges move out of alignment with the elongated ends retains the plug by engagement of the flanges with the shoulder.

3. The assembly as in claim 2, wherein the elongated slot has a generally circular center section, and wherein the generally circular center section of the slot is large enough to allow passage of the body through the slot.

4. The assembly as in claim 2, wherein the shoulder is a cap removably threadedly connected to the sleeve.

5. The assembly as in claim 2, wherein the adapter has a washer in the bore and a spring between the washer and an opposing radially inwardly depending shoulder in the bore so that, upon insertion of the plug and the flanges into the bore, the flanges engage the washer and the spring biases the plug in a direction toward the upper end of the sleeve.

6. The assembly as in claim 1, wherein the plug comprises two sections separate from each other and threadedly connectable to each other.

7. A spark plug assembly, comprising:

a spark plug comprising a first inner conductor exposed at an upper end of the plug, a first outer conductor, an insulator disposed between the inner conductor and outer conductor, and a threaded outer surface of a lower end of the plug opposite the upper end of the plug;

an elongated extension member comprising a first bore at an upper end of the extension member, the first bore defining a threaded inner surface that threadedly receives the threaded outer surface of the lower end of the plug to thereby secure the plug to the extension member, a second inner conductor disposed within the first bore so that the first inner conductor electrically engages the second inner conductor when the spark plug is threadedly secured to the extension member, a second outer conductor disposed so that the first outer conductor electrically engages the second outer conductor when the plug is threadedly secured to the extension member, wherein at a lower end of the extension member, the second inner conductor and the second outer conductor respectively terminate to define a gap there between across which a spark is created in use of the plug; and an adapter comprising a sleeve that defines a second bore that receives the extension member through an upper end of the sleeve and a thread on an outer surface of a lower end of the sleeve opposite the upper end, and a retainer connected between the sleeve and the plug so that, when the extension member is inserted into the second bore so that the inner and outer conductors extend out of the lower end of the sleeve and the gap is outside the sleeve, the retainer retains the extension member in the bore against movement out of the second bore through the upper end in a direction along an axis of the second bore, wherein the retainer allows rotation of the extension member about the axis when the extension member is inserted into the second bore and retained by the retainer, wherein a first indexing mark is disposed on at least one of the plug and the extension member, and wherein a plurality of second indexing marks are disposed on the adapter so that, upon insertion of the plug and the indexing member into the adapter, alignment of the first indexing mark with any one of the second indexing marks brings an opening of the gap to a predetermined rotational position with respect to the axis.

* * * * *